US005247798A

United States Patent [19]

Collard, Jr.

[11] Patent Number: 5,247,798

[45] Date of Patent: Sep. 28, 1993

[54] PORTABLE REFRIGERATOR

[75] Inventor: Thomas H. Collard, Jr., San Antonio, Tex.

[73] Assignee: Elwood H. Carpenter, Helotes, Tex.

[21] Appl. No.: 5,843

[22] Filed: Jan. 19, 1993

[51] Int. Cl.[5] ..... F25B 21/02

[52] U.S. Cl. ..... 62/3.62; 62/457.5; 221/266; 221/281; 232/43.3

[58] Field of Search ..... 62/3.6, 3.62, 3.64, 62/457.5; 221/266, 281; 232/43.1, 43.3, 44

[56] References Cited

U.S. PATENT DOCUMENTS

| | | | |
|---|---|---|---|
| 224,383 | 2/1880 | Bruggen | 62/389 |
| 951,323 | 3/1910 | Mathewson | 62/250 |
| 1,369,440 | 2/1921 | Jones | 62/250 |
| 2,279,093 | 4/1942 | Peters | 312/48 |
| 3,445,037 | 5/1969 | Rothbaum | 221/266 X |
| 4,308,974 | 1/1982 | Jones | 221/266 X |
| 4,326,383 | 4/1982 | Reed et al. | 62/3.62 |
| 4,328,676 | 5/1982 | Reed | 62/3.62 |
| 4,510,770 | 4/1985 | Vella | 221/281 X |
| 4,663,943 | 5/1987 | Dyment et al. | 62/250 |
| 4,676,074 | 6/1987 | Morgan et al. | 62/277 |
| 4,704,870 | 11/1987 | Beitner | 62/3 |
| 4,899,904 | 2/1990 | Dooley et al. | 62/457.5 X |
| 5,029,446 | 7/1991 | Suzuki | 62/3.6 |

*Primary Examiner*—William E. Tapolcai

*Attorney, Agent, or Firm*—Gunn, Lee & Miller

[57] ABSTRACT

A portable cabinet for effecting the cooling of beverage containers by utilization of a thermoelectric cooling unit comprises a rectilinear cabinet having spaced inner and outer walls formed of plastic and having the space between filled with a foam plastic. An upper container insertion opening and a lower container removal opening is provided in the front wall of the cabinet. A core block is inserted within the inner walls of the container and cooperates with the inner wall surfaces of the cabinet to define a channel extending in a downward direction between the insertion opening and the discharge opening, thereby permitting an inserted cylindrical container to roll through the channel under the influence of gravity. Rotatable, insulated doors are provided in each of the openings and such doors are of generally cylindrical segment configuration but define a concave container receiving notch so that a container may be inserted into the cooling channel or moved therefrom without opening the cooling channel to an inflow of ambient air. The rear wall of the cabinet has an inclined insulated section. A metallic strip is mounted adjacent the rear wall and the bottom of the channel and overlies such opening. The thermoelectric cooling unit is positioned in the inclined insulated section and is thermally connected to the cooling strip.

19 Claims, 7 Drawing Sheets

PORTABLE REFRIGERATOR

BACKGROUND OF THE INVENTION

1. Field of the Invention:

This invention relates to a refrigerator employing a thermoelectric cooling apparatus, specifically designed for the cooling of cans of beer or carbonated beverages and constructed in such a manner as to be readily portable.

2. Summary of the Prior Art:

Ever increasing numbers of people have been participating in camping, picnicking, sports and similar outdoor activities, so there is an ever increasing need for a light weight, compact, readily portable refrigerating unit suitable for cooling of potable liquids, such as beer and/or carbonated beverages. Additionally, many people prefer their drinks to be in a "slushy", almost frozen state. The utilization, in a portable unit, of a conventional cooling system employing a compressor, condenser and evaporator is essentially ruled out by the excessive weight and space necessarily involved in the design of such mechanical units. While thermoelectric cooling units have heretofore been proposed for refrigeration purposes, as shown in U.S. Pat. No. 4,704,870, substantial space is required for the mounting of such units. Since the cooling rates achieved by a thermoelectric unit is substantially less than that of the compressor-condenser-evaporator type unit, the extraction of heat from the liquid containers and the insulation of the cabinet containing the liquid containers must be substantially more efficient than the compressor-condenser-evaporator type unit, yet achieve the cooling objective with a total size and weight which is less than such known units, resulting in a cooling apparatus for liquids that is readily portable.

SUMMARY OF THE INVENTION

The invention provides a cabinet of rectilinear shape having front, back, side, top and bottom insulated walls. The top portions of the back wall are vertical but the lower portions are inclined toward the front wall. Within the cabinet, a channel is provided which is designed to permit rolling movement of a can or other cylindrical container of a beverage, from an insertion opening in the upper portion of the front wall of the cabinet to a dispensing opening in the bottom portion of the front wall of the cabinet.

Such channel is defined by spaced inner and outer wall surfaces and includes an upper slightly downwardly inclined portion communicating with the upper insertion opening, a lower slightly inclined portion communicating the lower discharge opening, and an intermediate portion connecting the upper and lower channel portions and including a vertically inclined portion which is parallel to the inclined portion of the rear wall. All of the outer wall of the channel is preferably formed of a good heat conducting material, such as sheet aluminum. The inner wall of the channel is formed by a foam-filled core of a plastic material. While this summary will deal with only a single can channel, any number of such channels can be provided. In a preferred embodiment of this invention, a pair of such channels are provided in side-by-side relationship within the cabinet and are separated by a vertical partition of plastic.

A pair of substantially identical insulated doors are rotatably disposed respectively in the insertion and dispensing openings of the cabinet. Each door is of an insulated hollow configuration with a major portion of the door being defined by a cylindrical segment surface. A minor portion of each door is defined by a concavely arcuate surface proportioned to receive a single liquid container within its concave portion. See, for example, U.S. Pat. No. 1,369,440. Thus, rotation of the door can effect the transfer of a warm metal can or a plastic bottle of liquid into the insertion opening, or the removal of a cooled can or bottle of liquid from the discharge opening, without exposing the interior of the channel or cabinet to the exterior, hence preventing inflow of ambient air surrounding the cabinet into the cooled interior or outflow of cooled air. Thus, whether a can or bottle of liquid is inserted in the cabinet through the upper door or removed through the lower removal door, the container cooling channel between the two doors is never opened to ambient air.

In a preferred embodiment of the invention, a major portion of the outer channel defining wall is formed of a good heat conducting material such as aluminum. The thermoelectric unit is of a conventional panel configuration and has a cold surface and a hot surface. The thermoelectric unit has its cold surface secured to a block of aluminum abutting the metallic portion of the aforementioned outer channel wall, thus transmitting the cooling effect to the outer wall of the channel, and effecting the cooling of the liquid containers in contact therewith by conduction, and the remainder of the interior of the cabinet by convection. The hot surface of the thermoelectric unit is detachably engaged by a heat sink plate. A fan is provided to cool the heat sink plate during operation of the thermoelectric cooling unit.

The inner wall of the cooling channel is defined by a block of molded foam plastic which is molded in such a manner as to produce a tough, unfoamed skin on the exterior surfaces thereof. Alternatively, the periphery of the inner core block may be extruded and then filled with a foamed plastic.

The forward ends of both the upper and lower portions of the core block forming the inner wall are contoured to respectively provide arcuate abutting surfaces for the rear portions of the upper and lower doors. If desired, the openings in the front wall defining the top and bottom access to the channels within the cabinet may be upper and lower portions, respectively, of a single opening in the cabinet front wall. Thus, an open space is provided between the upper and lower channel openings which may be filled with an insulated plastic closure element whose top and bottom surfaces are respectively contoured to respectively engage the forward bottom and top surfaces of the upper and lower doors, thus providing securement of the doors in a rotatable position within the cabinet. This so-called closure element is preferably detachably secured by screws to the front face of the inner core block, permitting ready removal of the closure element and the doors for cleaning purposes.

The core block may have a recess to provide for mounting a removable mass of desiccant material in communication with the cooling channel. Such recess is accessible through an opening in a side wall of the cabinet which is normally closed by an insulated removable plug.

As is well known, the thermoelectric cooling unit is operated by direct current. For this reason, a transformer and rectifier are provided, which may be mounted on the rear wall in the space above the inclined portion of the rear wall of the cabinet, to permit conventional 120 volt alternating household current to be rectified to 12 volt direct current to be supplied to the thermoelectric unit. Additionally, a cord connection is provided to the input terminals of the thermoelectric panel which terminates in a plug which is insertable in a cigarette lighter of a car or truck, thus permitting energization of the thermoelectric panel by the battery of a car or truck.

With this alternative electrical supply arrangement, the interior of the cooling cabinet and an initial load of liquid containers can be brought down to a near freezing point by operation from household current, prior to the departure on a trip to an area where electrical power is not available. During the trip, the cooling may be continued by plugging the portable cooling unit into the cigarette lighter of the car or truck and such cooling may be continued after the arrival at the selected camping, sport or picnic site.

All walls of the cabinet are provided with suitable insulation, such as foamed plastic material and, once the interior is cooled, such insulation maintains the coldness of the containers for four or more hours, depending on the ambient temperature to which the cooling cabinet is exposed. This is normally sufficient time to maintain a supply of cooled beverage during camping, picnic or sports activities away from the car or truck.

Preferably, a heat sink plate is manually pulled into engagement with the hot surface of the thermoelectric cooling unit, and is held in such engagement by a solenoid operated latch, which is energized concurrently with the cooling unit. When power is removed from the cooling unit, the solenoid plunger retracts and compressed resilient elements move the heat sink plate out of engagement with the thermoelectric cooling unit, thus preventing flow of heat from the heat sink plate into the interior of the cooling cabinet.

As previously mentioned, the preferred embodiment of this invention provides two side-by-side identical can cooling channels within the cabinet, including a thermoelectric cooling unit for each channel, in order to increase the capacity of the cooling unit to accommodate four six-packs (or 2-12 packs) of containers. In such preferred embodiment, the two channels are vertically divided by a plastic divider element which has a hollow opening therethrough to snugly surround the core block which defines the inner channel walls of both channels. The divider element also encircles and supports a horizontal shelf which is critical for preventing "nesting" of the cans. The divider wall is suitably secured to the top wall of the inner wall unit by insertion into a recess therein. With this arrangement, one channel only may be used and liquid containers may be cooled and stored therein, regardless of whether the second channel is in use.

Other advantages of the invention will be readily apparent to those skilled in the art from the following detailed description, taken in conjunction with the annexed sheets of drawings, on which is shown a preferred embodiment of the invention.

DESCRIPTION OF THE PREFERRED EMBODIMENT

Figure 1:
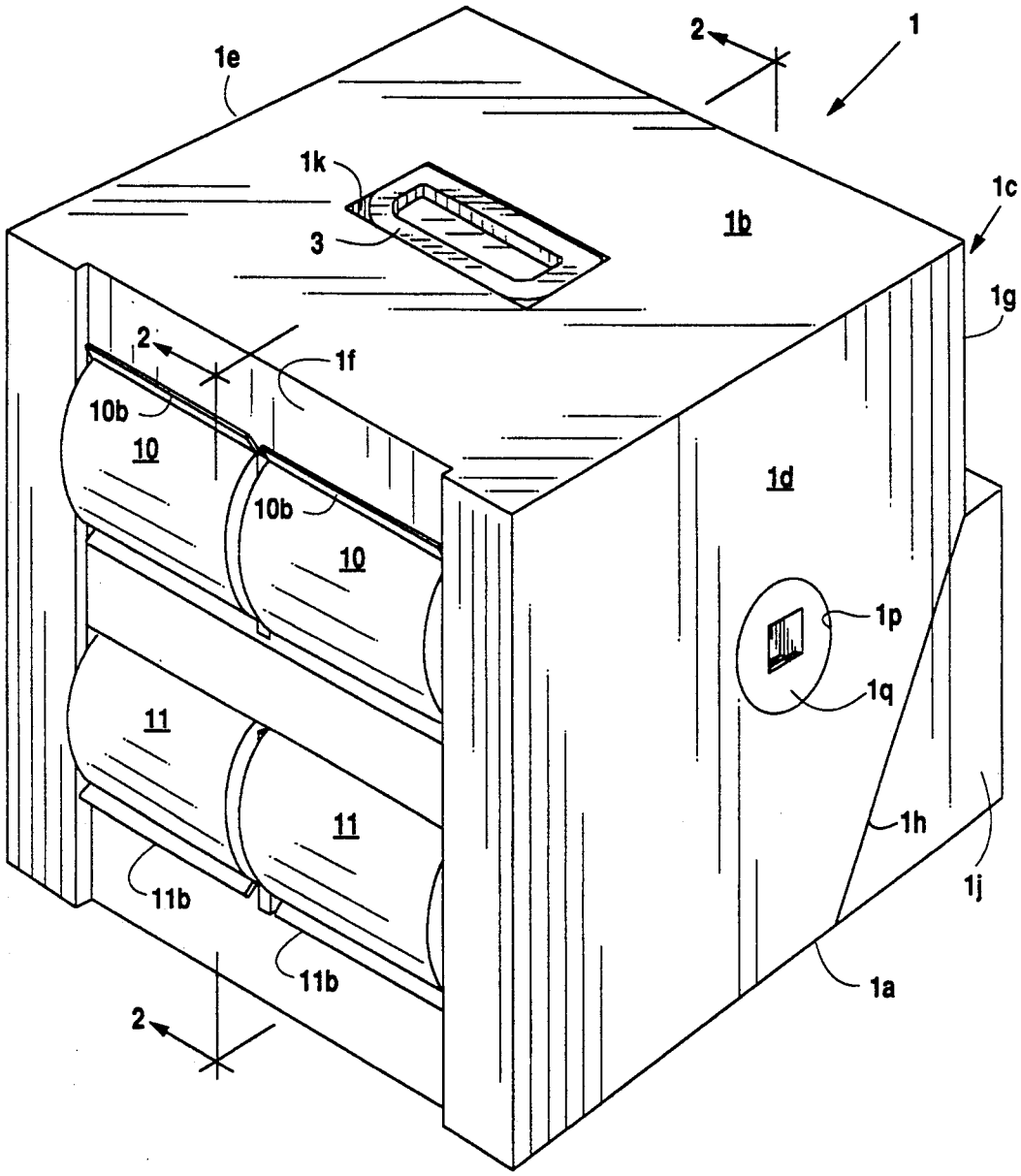
FIG. 1 is a perspective view of a portable beverage cooler embodying this invention.
Figure 2A:
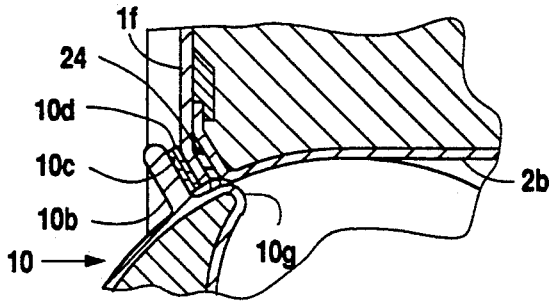
FIG. 2A is an enlarged view of a portion of FIG. 2.
Figure 2:
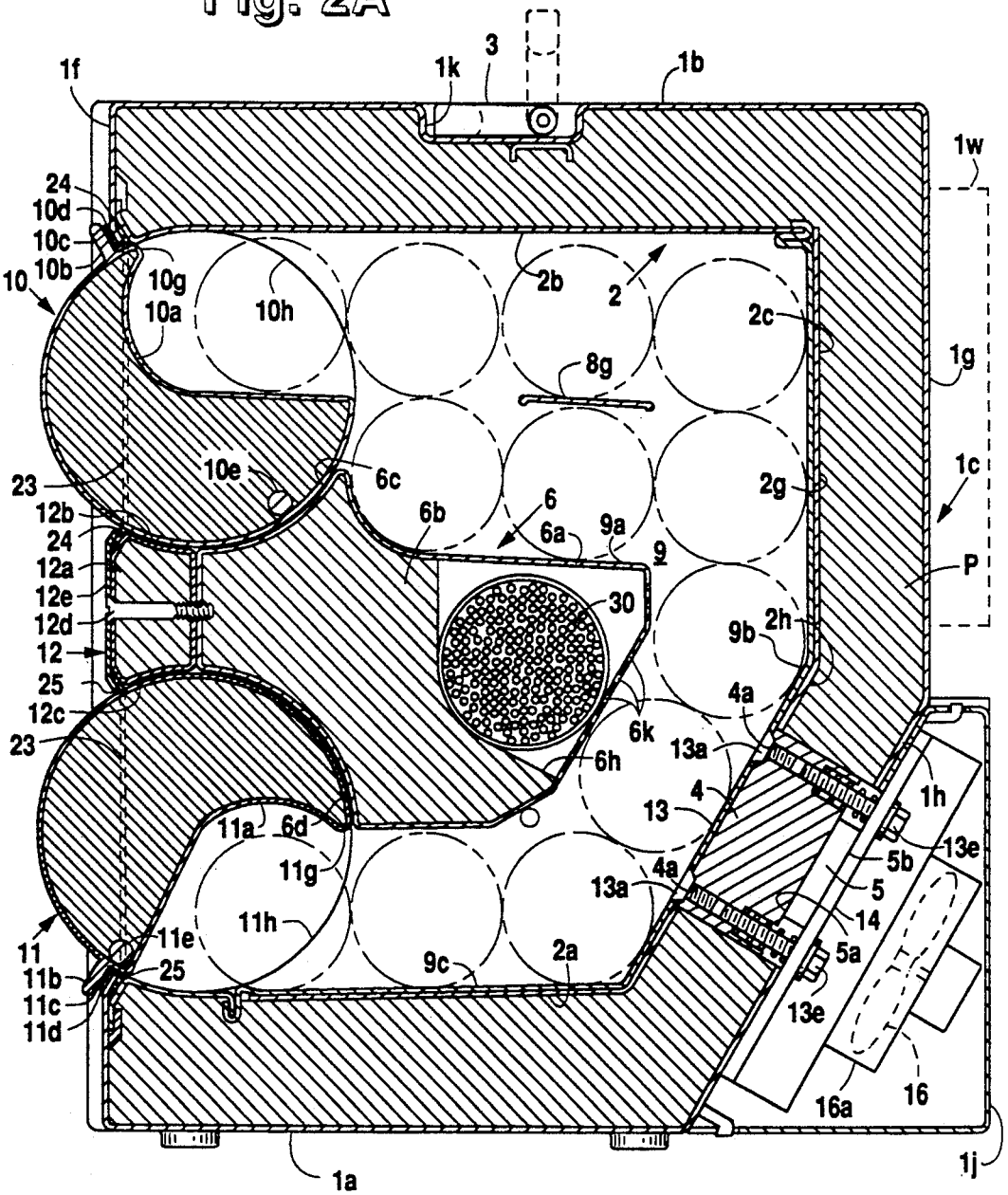
FIG. 2 is a schematic vertical sectional view taken on the plane 2—2 of FIG. 1.

Referring to FIGS. 1 and 2 there is shown a portable beverage container designed for the cooling of conventional sizes of generally cylindrical metal cans or bottles containing a potable beverage. Cabinet 1 may be fabricated from metal or plastic sheets, such as aluminum or polypropylene, or injection or rotational molded plastics, such as polypropylene, and has a bottom wall 1*a*, a top wall 1*b*, a rear wall 1*c*, opposed side walls 1*d* and 1*e*, and a front wall 1*f* conventionally secured together. An internal wall unit 2 (FIG. 2) is provided, preferably formed of high density polyethylene, having a configuration similar to the outer walls 1*a*–1*e* but being of smaller dimensions. Thus the inner wall unit 2 has a bottom wall 2*a*, a top wall portion 2*b*, back flange 2*c*, and side wall portions 2*d* and 2*e*, (FIG. 4) thereby defining a space between the respective inner and outer walls which is filled with a suitable insulating material such as foamed-in-place polyurethane P.

Top wall 1*b* is provided with a downwardly recessed portion 1*k* to define a mounting for a carrying handle 3 which is horizontally pivotally mounted in said recess near the center of gravity of the refrigerator. Carrying handle 3 is normally horizontally positioned in the recess 1*k* but may be pivoted to a vertical, carrying position as shown by dotted lines in FIG. 2.

Figure 7:
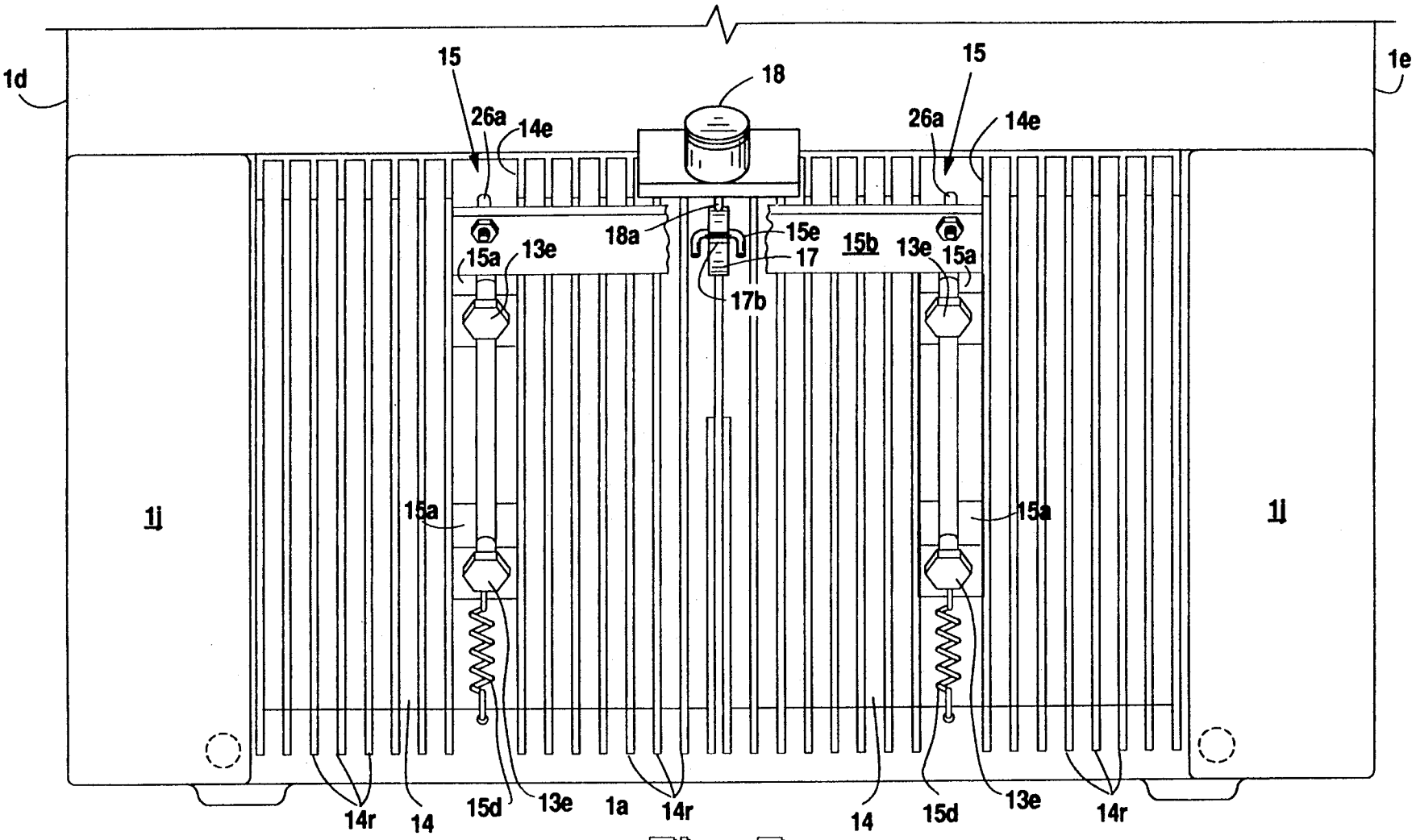
FIG. 7 is a rear elevational view of the heat sink plates.

The back wall 1*c* has an upper vertical portion 1*g* which is connected to the bottom wall 1*a* by an inclined portion 1*h*. A similarly inclined portion 2*h* is provided on the inner wall unit 2. Between inclined wall portions 1*h* and 2*h*, and rear wall 1*c* a space is defined for mounting a heat transfer mass 4, preferably of aluminum, and a thermoelectric cooling unit 5, which are enclosed by polyurethane foam P. Adjacent the outer or hot face 5*b* of cooling unit 5 is mounted a metallic heat sink plate 14 and a cooperating cooling fan 16, as will be described in more detail later. Each end of the inclined rear wall portion 1*h* of cabinet 1 is enclosed by a generally right angular plastic or sheet metal housing 1*j* to contain the electronic control components (FIG. 7).

A cooling channel 9 for beverage containers, such as 12 oz cans shown in dotted lines, is provided between the inner surfaces of the inner wall unit 2 and an inserted block or core 6, which may comprise a solid block of light weight plastic material, such as foamed polyethylene with an unfoamed skin, or, as illustrated in the drawings, may comprise an extruded shell 6*a* of high density polyethylene filled with a mass of polyurethane insulating foam 6*b*.

Figure 4:
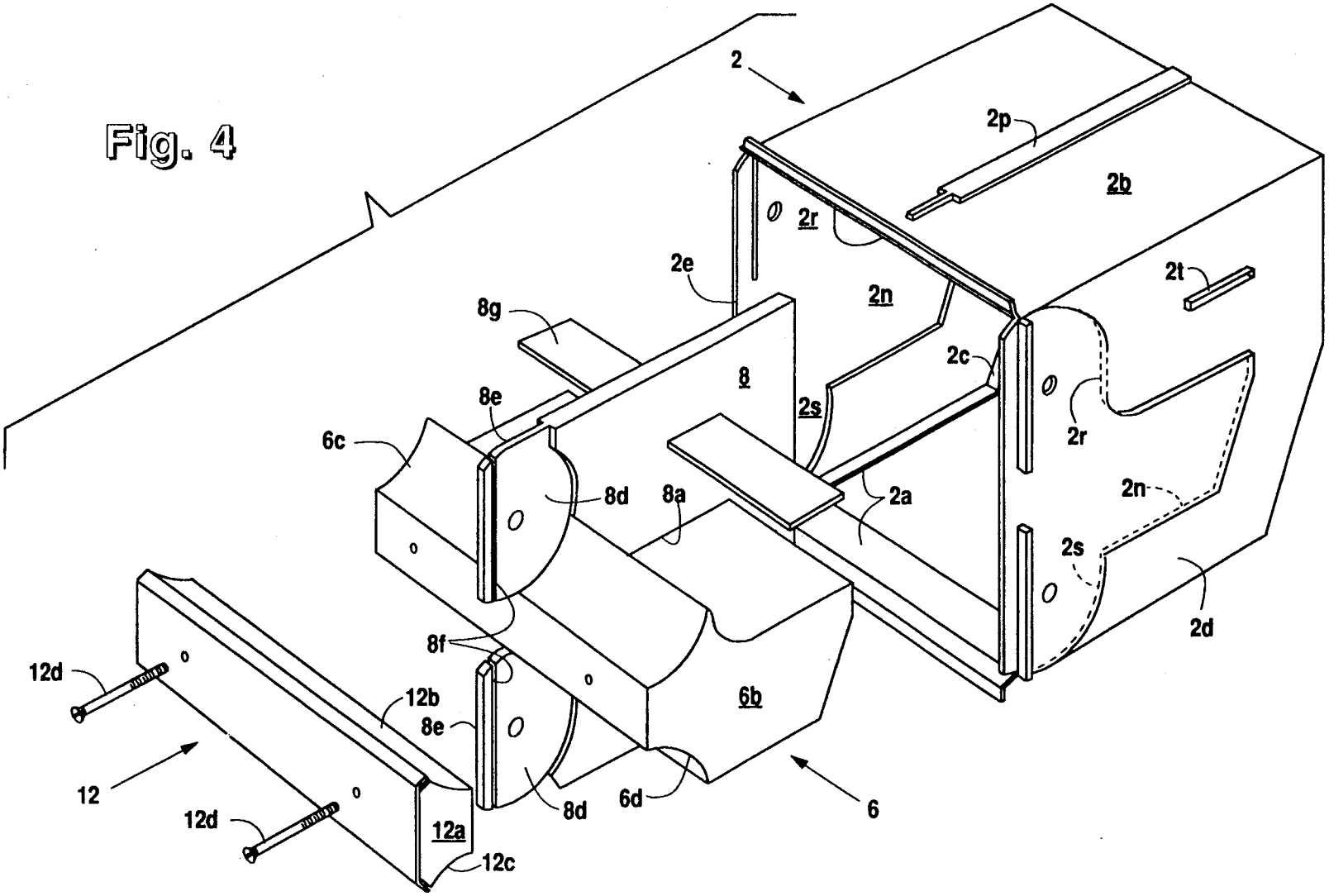
FIG. 4 is a schematic exploded perspective view illustrating the assemblage of the inner channel defining core block and the vertical partition relative to the internal cabinet wall unit.

As best shown in FIG. 4, inner side walls 2*d* and 2*e* are each provided with shallow recesses 2*n* and 2*t* of the same shape as the ends of core 6 and a horizontal shelf 8g, respectively, to snap engage the opposed ends 6b of core 6 and the ends of shelf 8g as core unit 6 is forced through the open front end of inner wall 2. Also, vertically spaced, shallow, cylindrical segment recesses 2r and 2s are formed in the front portions of side walls 2d and 2e flush with recesses 2n to respectively rotatably support portions of cylindrical doors 10 and 11 at the ends of channel 9, as will be described.

Cooling channel 9 has a slightly downwardly inclined upper portion 9a extending from the front to the rear of cabinet, a forwardly and downwardly inclined medial portion 9b and a slightly downwardly inclined, lower portion 9c extending to the center line of the cylindrical doors 10. Thus any cylindrical container, such as a can, will gravitationally roll through channel 9.

The number of cooling channels provided is determined by the desired capacity of the portable cooling unit. Obviously, the greater the capacity, the greater will be the weight of the portable cooling apparatus. Preferably, the cooling apparatus is designed with either one cooling channel capable of taking twelve containers of 12 oz. size or, as shown in the drawings, with two cooling channels, each capable of receiving twelve containers in side by side relationship.

The two cooling channels 9 are separated by a vertical partition 8, (FIG. 4) which defines an opening 8a of the same configuration as the external configuration of the channel defining core block 6. In fact, the vertical partition 8 is snugly mounted around the core block 6 and shelf 8g before insertion of the core block 6 and the shelf 8g into the inner wall unit 2. The top end of partition 8 snaps into a slot 2p formed in the top surface 2b of the inner wall unit 2 to maintain it in position. Partition unit 8 is made preferably of polyethylene. The forward end of partition 8 defines back to back semi-cylindrical indentations 8d and 8e to receive a portion of the ends of cylindrical doors 10 and 11. O-ring grooves 8f are provided to provide silicone O-ring gasketing 23 (FIG. 2) for the inner ends of doors 10 and 11.

As best shown in FIGS. 2 and 4, the core 6 has its forward end configured to provide arcuate surfaces 6c and 6d which respectively cooperate with the periphery of the cylindrical upper and lower doors 10 and 11. As previously mentioned, the ends of these doors are also inserted in the shallow recesses 2r and 2s provided in the forward ends of the side walls 2d and 2e of the inner wall unit 2.

The doors 10 and 11 are of substantially identical construction and have a generally cylindrical configuration extending over about 270 degrees of their periphery, with thin 360 degree ends 10h and 11h. A concave contour 10a and 11a (FIG. 2) are respectively provided in the doors 10 and 11 which permits a beverage can to be inserted therein. The upper door 10 has an elongated operating handle 10b disposed at the location of the juncture 10g of the concave contour 10a and the outer cylindrical periphery of door 10. Handle 10b mounts a magnetic strip 10c and a magnetic strip 10d is secured to the adjacent portion of the front wall 1f. (FIG. 2A) A similar magnetic strip 11c on handle 11b and magnetic strip seal 11d are provided for the bottom door 11 to secure it in its closed position. U-shaped gasket strip 24 of a silicon elastomer extends from the inner and top portion of door 10, around the outer portion of door 10, along the bottom portion of door 10, and terminates at the inner and bottom portion of door 10. U-shaped gasket strip 24 is suitably secured between the front wall 1f and inner top 2b of cabinet 1 and between the front plate 12e and closure element 12 to sealingly engage the cylindrical peripheries of door 10.

The apex 11g of the concave contour of door 11 prevents the cans from rolling down while one is being removed. When the door is re-closed, another moves into place. If desired, weighting bars 10e and 11e may be respectively mounted within the doors 10 to provide a gravitational bias to the door 10 or door 11 urging each door to its closed position shown in FIG. 2.

It should be noted that the core block 6 does not restrain the doors 10 and 11 within the cabinet 1. The actual restraint is imposed by a closure element 12 which may comprise an extruded hollow length of polypropylene which is filled with a polyurethane foam 12a. Closure element 12 is provided with arcuate surfaces 12b and 12c which respectively cooperate with the bottom forward surface of the upper door 10 and the top forward surface of the bottom door 11 to maintain the doors in assembled relationship. Closure element 12 is preferably secured to the front face of the core block 6 by suitable screws 12d. U-shaped gasket strip 25 of a silicon elastomer extends from the inner and top portion of door 11, around the outer portion of door 11, along the bottom portion of door 11, and terminates at the inner and bottom portion of door 11. U-shaped gasket strip 25 is suitably secured in the same manner as U-shaped gasket strip 24 to sealingly engage the cylindrical peripheries of door 11.

Figure 5:
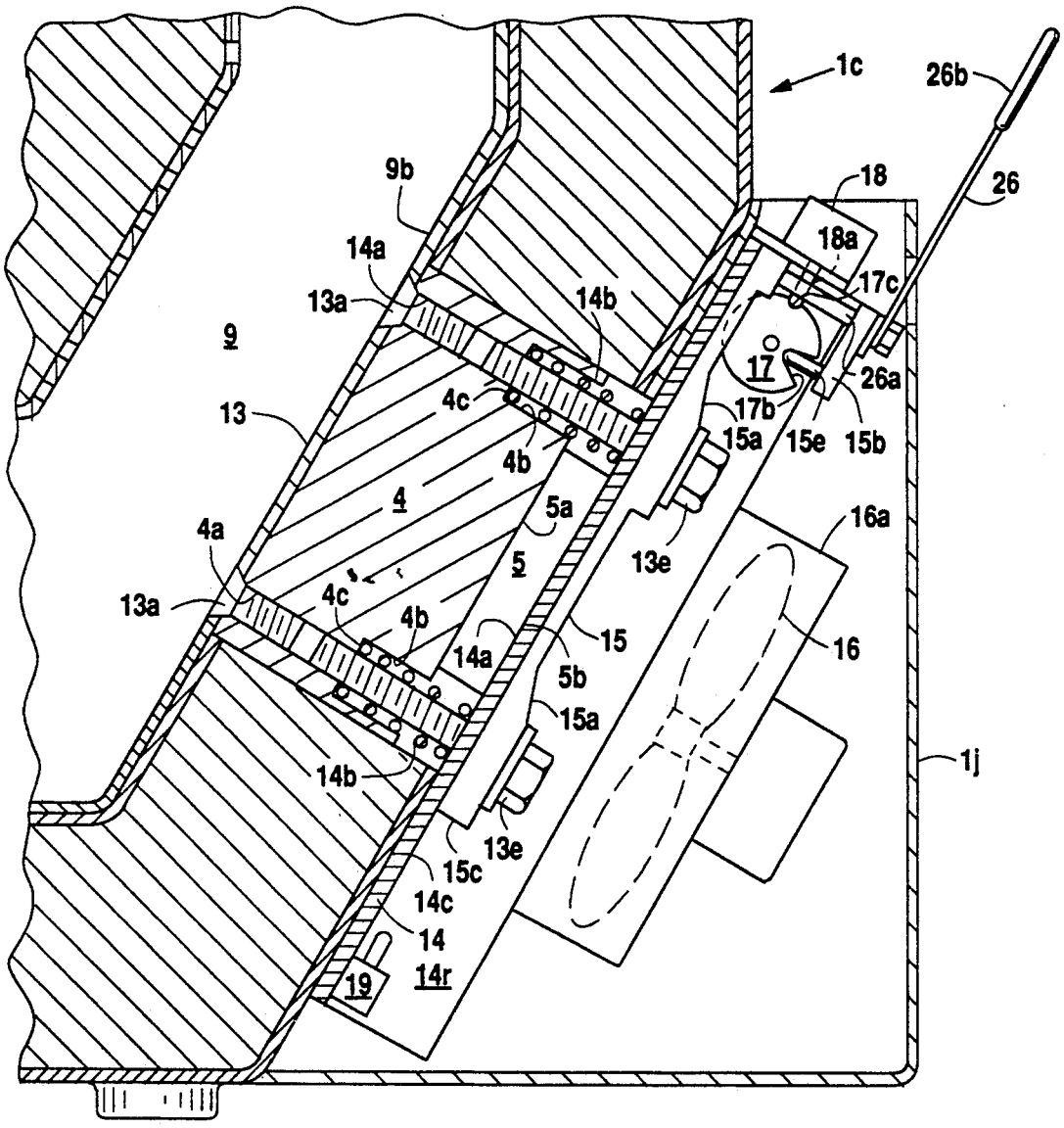
FIG. 5 is an enlarged scale view of the rear portion of FIG. 1 illustrating the shiftable mounting of the heat sink plate in its operable position.
Figure 6:
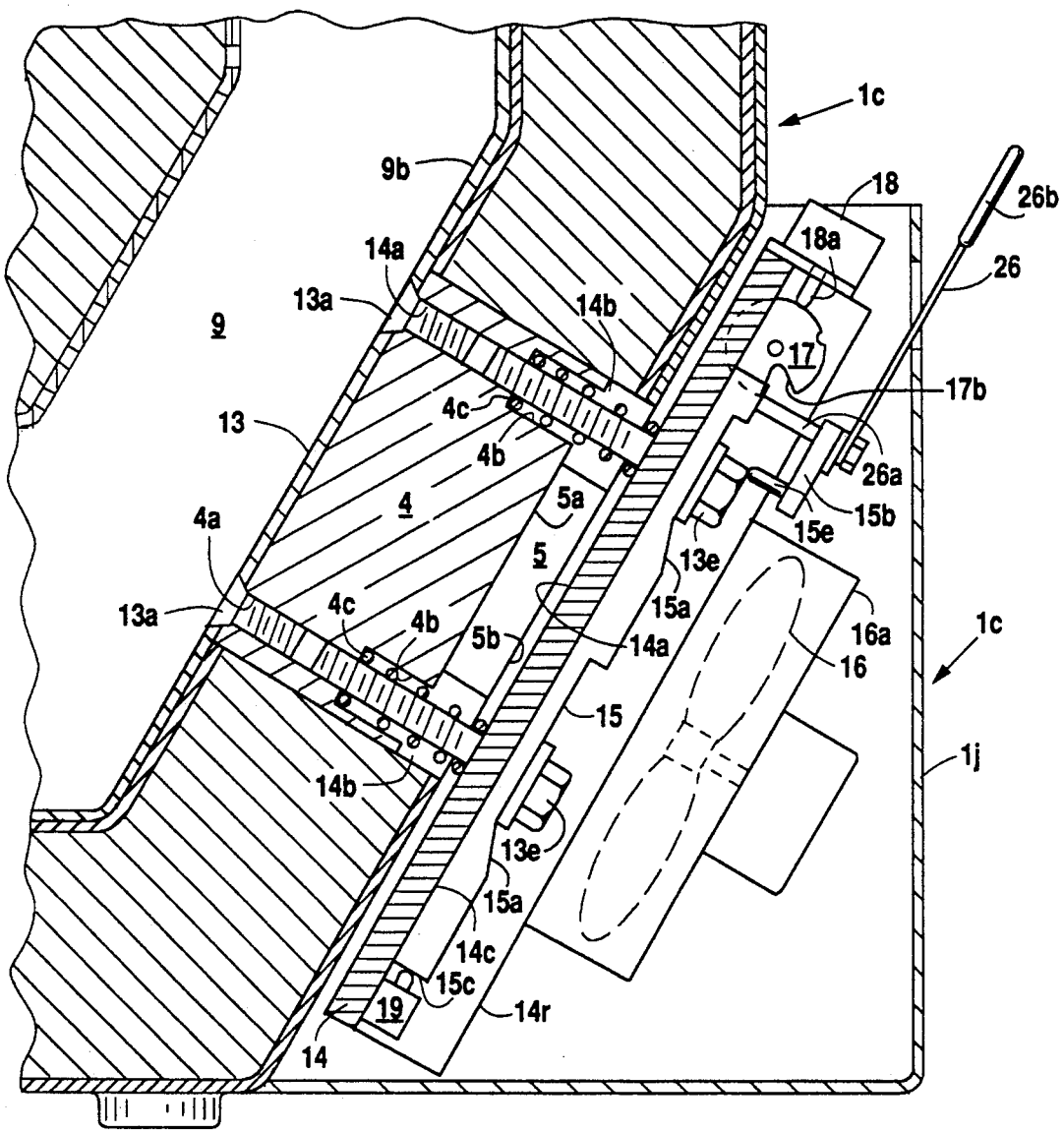
FIG. 6 is a view similar to FIG. 5 but showing the heat sink plate in an inoperable position.

As best shown in FIGS. 5–7, an aluminum heat transfer block 4 and a thermoelectric cooling unit 5 are thermally connected to a metal cooling plate 13 which overlies the bottom and rear portions of the outer wall of each channel 9 defined by the inner wall unit 2. Such engagement is accomplished by screws 13a which engage threaded holes 4a in heat transfer block 4 to hold cooling strip 13 in engagement with the heat transfer block 4, which abuts the cold side 5a of the thermoelectric cooling unit 5.

The hot side 5b of the thermoelectric cooling unit 5 is abuttingly engaged with a heat sink plate 14 only during operation. A motor driven fan 16 mounted within a housing 16a is suitably mounted relative to the respective heat sink plate 14 so as to direct cooling air along such plate to dissipate the heat trapped in such plate and prevent it from entering the cooled interior of the cabinet 1. Suitable apertures (not shown) are provided in the external housings 1j to permit a flow of air into and out of such housings to ventilate the electronic circuits therein. Referring to FIG. 5, a counterbored recess 4b is provided in the end of each screw hole 4a from the thermoelectric unit side. A compression spring 4c is inserted in the bottom of each recess 4b and such springs are compressed by a pair of plastic spacer sleeves 14b which press on the face 14a of the heat sink plate 14 that is adjacent to the hot face 5b of the thermoelectric cooling unit 5. Thus, springs 4c normally urge the heat sink plate 14 to the position shown in FIG. 6 where there is no direct contact between the heat sink plate 14 and the hot surface 5b of the thermoelectric unit 5.

As shown in FIG. 7, two heat sink plates 14 are provided which respectively cooperate with thermoelectric cooling units 5. Each has a plurality of vertical cooling ribs 14r on its back face.

Each heat sink plate 14 is manually shifted into abutting relationship with the hot surface 5b of the thermoelectric cooling unit 5 by a cam unit 15, which is suitably mounted for sliding movement along the external face of the heat sink plate 14 in a channel 14*e*. Cam units 15 are manually moved upwardly by a cable 26 (FIG. 5) which is attached at one end to a spanner plate 15*b* joined to cam units 15 by rods 26*a*. A ring 26*b* is attached to the other end of cable 26 to facilitate pulling of the cable to move cam units 15 upwardly. A pair of springs 15*d* (FIG. 7) oppose such upward movement.

Cam unit 15 is provided with two cam surfaces 15*a* which respectively engage cam bolts 13*e* provided in each of the screw holes 4*a*. Such engagement effects the movement of the heat sink plates 14 respectively into abutting engagement with the hot surfaces 5*b* of the thermoelectric cooling units 5. The heat sink plates 14 are secured in this abutting position, shown in FIG. 5, by a rotatable latch 17 having a locking detent 17*c* engagable with the plunger 18*a* of the solenoid 18. A U-shaped rod 15*e* is mounted on spanner 15*b* and cooperates with a V-notch 17*b* provided on rotary latch 17 to return latch 17 to its latching position as cam units 15 are moved upwardly by cable 26 and rods 26*a*. The rotatable latch 17 is secured in its latching position by the plunger 18*a* of a solenoid 18.

Figure 3:
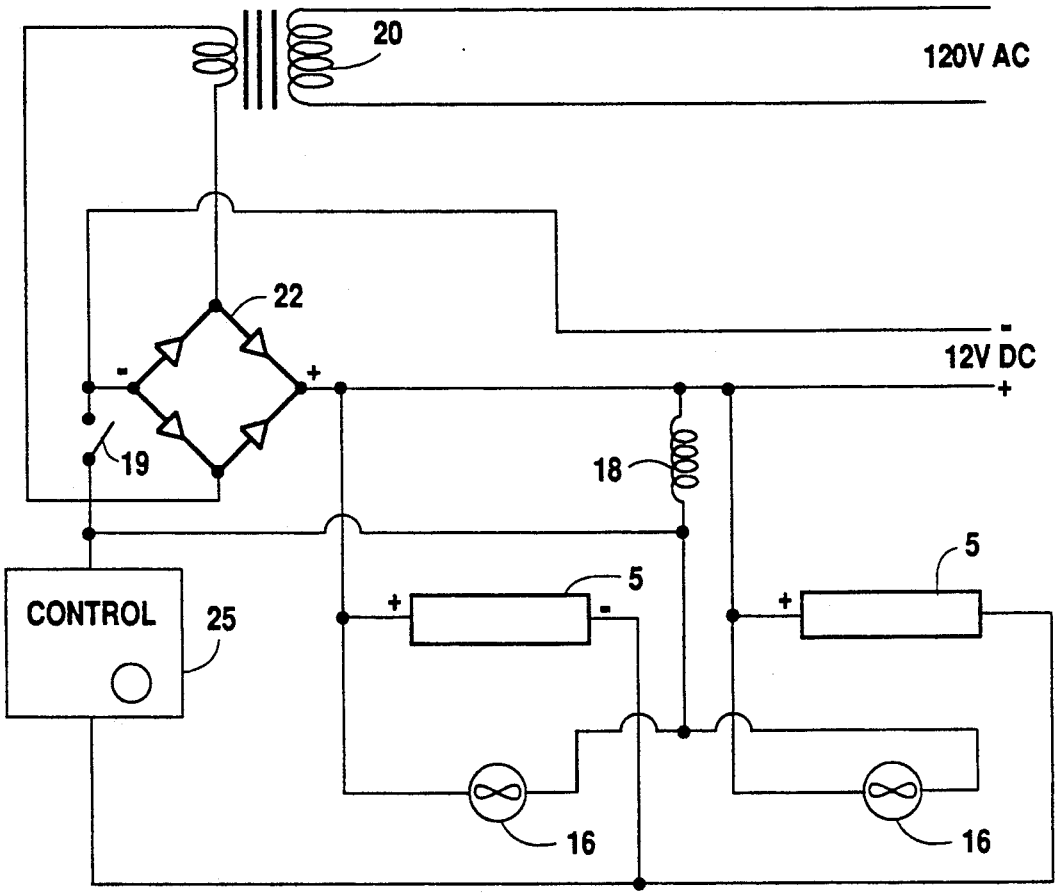
FIG. 3 is a schematic circuit diagram illustrating the selective operation of the beverage cooling apparatus from either 120-volt AC source or a 12-volt DC source.

As is apparent from the circuit diagram of FIG. 3, solenoid 18 is energized concurrently with the thermoelectric cooling units 5 and the fans 16. When power is disconnected from unit 5, the solenoid plunger 18*a* retracts, permitting latch 17 to rotate and cam 15 to slide downwardly under the bias of springs 15*d*. Heat sink plates 14 are moved out of contact with heated surfaces 5*b* of thermoelectric units 5 by compressed springs 4*c*. This minimizes heat flow from heat sink plate 14 into the interior of cabinet through thermoelectric unit 5, heat transfer block 4, and cold plate 13.

As will be readily apparent from observing FIG. 2, cans or bottles of generally cylindrical configuration, indicated by the dotted lines, may be loaded into either or both of the cooling channels 9 by rotating the upper door 10 to a position where the container receiving notch 10*a* is facing outwardly. In this position, the respective cooling channel 9 is still maintained in an isolated position relative to the ambient air. Rotating the upper door 10 to the closed position shown in FIG. 2 will permit the particular container to move into the respective cooling channel 9. As successive containers are loaded into such channel, they assume the positions shown in FIG. 2. The horizontal plastic shelf 8*g* prevents the jamming of the containers in the upper portions of the cooling channels 9. Similarly, the cooled container adjacent lower door 11 is removed by rotating such door to engage the container in the concave notch 11*a* to remove the container from the cabinet 1 without opening channel 9 to an inflow of ambient air.

If desired, a chamber 6*h* may be formed in core block 6 which is accessible through an opening 1*p* in side wall 1*d*, which is normally closed by an insulated plug 1*q*. A porous pouch containing a desiccant or water absorption material 30 may be inserted in chamber 6*h* to collect moisture in the interior of cabinet 1 through perforations in a wall 6*k* closing chamber 6*h*.

Energization of the thermoelectric cooling units 5 is effected by switch 18 and control 25 shown in FIG. 3 which permits the application of a direct current of approximately 12 volts in magnitude to be applied to each thermoelectric cooling unit 5. Switch 19 is a normally "on" type, which is turned "off" by cam unit end 15*c* when solenoid 18 is de-energized. Concurrently, the solenoid 18 and the respective cooling fans 16 are energized to hold heat sink plates 14 in contact with the hot sides 5*b* of thermoelectric cooling units 5 and maintain a stream of cooling air in contact with the heat sink plates 14. A conventional transformer 20 and bridge type rectifier 22 permit the utilization of 120 volt AC to operate the cooling units 5, the fans 16 and solenoid 18. Transformer 20 and rectifier 22 are preferably mounted on back wall 1*c* covering the upper rear wall portion 1*g* in the space shown as 1*w* (FIG. 2). Since the amount of cooling is generally a function of the applied voltage, an adjustable solid state control 25 is inserted in the energization circuit to permit manual adjustment of the voltage applied to the respective cooling units 5.

Thus, the cooling apparatus embodying this invention may be loaded with beverage containers in the home, prior to departure on a camping trip and brought down to near freezing temperature by plugging the apparatus into household current. While the unit is being transported by car or truck, the 12 volt DC connection may be plugged into a cigarette lighter for cooling action. Thus, when the outdoor location is reached for the particular recreational activity, the beverage is still ready to drink at a near freezing temperature.

Upon disconnection of the cooling apparatus from any power source, the solenoid 18 is de-energized and the heat sink plates 14 move out of engagement with the hot sides 5*b* of the thermoelectric cooling units 5, thereby preventing the transmission of heat stored in the heat sink plate, or transferred to the cooled heat sink from ambient air, to the chilled contents of the cabinet 1. Simultaneously, cam unit 15 keeps the circuit open by opening switch 19 until it is reset manually by pulling cable 26. The insulation provided in the cabinet walls, plus the fact that the removal of containers from the cabinet through the lower doors 11 does not permit ambient air to enter the respective cooling channel, insures that the chilled beverage containers will remain cool for a substantial number of hours.

The portability of the described apparatus embodying this invention is greatly enhanced by the utilization of plastic for all structural elements, together with the use of foam plastic for insulation which results in a substantial reduction in weight of the apparatus.

Modifications of this invention will be readily apparent to those skilled in the art and it is intended that all such modifications be included within the scope of the appended claims.

What is claimed and desired to be secured by Letters Patent is:

1. A compact cooling unit for a plurality of equal size, liquid filled containers having cylindrical body portions, comprising, in combination:

a cabinet having front, back, side, top and bottom walls;

said front wall having two vertically spaced openings sized to permit ready passage of the containers therethrough with the cylindrical axis of the containers disposed horizontally;

means in said cabinet defining a channel supporting the containers for rolling movement between said upper opening and said lower opening, thereby permitting stacking of a plurality of said containers in said channel;

said channel having an upper portion communicating with said upper opening; a lower portion communicating with said lower opening, and an intermediate portion connecting said upper and lower portions and having a rear wall portion inclined relative to said bottom and back walls of said cabinet;

said channel rear wall portion and the bottom wall of said intermediate portion bottom being formed of metallic material;

a thermoelectric cooling unit mounted in said inclined rear wall portion and having a cooling surface;

a heat transfer means between said cooling surface and said metallic inclined rear wall of said channel, thereby cooling said containers by conduction and the interior of said cabinet by convection;

an insulated door mounted in each said front wall opening for rotation; and each said door being constructed and arranged to pass a container through the respective opening without opening the interior of the cabinet to an inflow of ambient air.

2. The apparatus of claim 1 wherein each of said rotatable insulated doors comprises a hollow body having an outer cylindrical segment wall and an inner wall concavely recessed to surround one of the cylindrical containers to move same through the respective door opening by rotation of the respective door.

3. The apparatus of claim 1 further comprising means for gravitationally biasing said rotatable doors to their respective closed positions relative to said upper and lower openings; and magnetic latch means for securing said rotatable doors in said closed positions.

4. The apparatus of claim 2 wherein said channel is defined by spaced inner and outer walls;

the forward portions of said inner wall extending between said rotatable doors and having vertically spaced arcuate contours respectively snugly engaging said outer cylindrical segment walls of said doors.

5. The apparatus of claim 4 wherein the forward ends of said arcuate contours of said inner wall are connected by a vertical wall substantially aligned with the axes of said rotatable doors; and a hollow closure element contoured to fill the space between said vertical wall and said rotatable doors;

said hollow closure element being filled with heat insulating material; and means for detachably securing said closure element in said space, whereby removal of said closure element permits removal of said rotatable doors.

6. The apparatus of claim 1 wherein said thermoelectric cooling means is powered by 12 volt D.C.; and means for alternatively connecting said thermoelectric cooling means to an AC-DC rectifier or to an automotive battery.

7. The apparatus of claim 1 wherein the inside wall of said channel is defined by a core block of insulating plastic supported between the side walls of said cabinet;

the peripheral surfaces of said core block defining the inner wall of said channel.

8. The apparatus of claim 4 wherein said inner walls of said channel is defined by an insulated plastic core element snugly inserted between said side walls of cabinet.

9. The apparatus of claim 8 wherein said plastic core element defines an internal recess; and a mass of desiccant contained in said recess to absorb water from the interior of said cabinet.

10. A compact cooling unit for a plurality of equal size, liquid filled containers having cylindrical body portions, comprising, in combination:

a rectilinear cabinet having front, back, side, top and bottom walls;

said front wall have a vertically extending opening sized to permit ready passage of the containers therethrough with the cylindrical axis of the containers disposed horizontally;

means in said cabinet defining a channel supporting the containers for rolling movement between the upper portion of said opening and a lower portion of said opening, thereby permitting stacking of a plurality of said containers in said channel;

said channel having spaced inner and outer walls;

said channel having an upper portion communicating with said upper opening, a lower portion communicating with said lower opening, and an intermediate portion connecting said upper and lower channel portions and having a rear outer wall disposed at an angle relative to said bottom and back walls of said cabinet;

said rear outer wall and the bottom wall of said lower channel portion being metallic;

a thermoelectric cooling unit mounted adjacent said rear outer wall and having a cooling surface; means for drawing heat from said metallic outer rear wall by said cooling surface, thereby cooling said channel by conduction and the interior of said cabinet by convection;

an insulated door mounted in each of said upper and lower portions of said opening for rotation;

each said door being constructed and arranged to pass a container through the respective opening without opening the interior of the cabinet to an outflow of cooled air contained therein; and removable insulated closure means for closing the open portion of said front wall intermediate said insulated doors.

11. The apparatus of claim 10 further comprising means for gravitationally biasing said rotatable doors to their respective closed positions relative to said upper and lower openings; and magnetic latch means for securing said rotatable doors in said closed positions.

12. A compact cooling unit for a plurality of equal size, liquid filled containers having cylindrical body portions, comprising, in combination:

a cabinet having front, back, side, top and bottom walls;

said front wall having two vertically spaced openings sized to permit ready passage of the containers therethrough with the cylindrical axis of the containers disposed horizontally;

means defining a channel supporting the containers for rolling movement between said upper opening and said lower opening, thereby permitting stacking of a plurality of said containers in said channel;

said channel having an upper portion communicating with said upper opening, a lower portion communicating with said lower opening, and an intermediate portion connecting said upper and lower portions and having a rear wall inclined at an angle relative to said bottom and back walls of said cabinet;

said inclined rear wall having a metallic surface;

a thermoelectric cooling unit mounted in said inclined rear wall and having a cooling surface and a heating surface;

heat conducting means between said cooling surface and said metallic rear wall, thereby cooling said containers by conduction and the interior of said cabinet by convection;

an insulated door mounted in each said opening for rotation;

each said door being constructed and arranged to pass a container through the respective opening by rotation of the respective door without opening the interior of the cabinet to an outflow of cooled air contained therein;

means for connecting said thermoelectric unit to an electrical power supply;

a heat sink plate contacting said heated surface of said thermoelectric cooling unit; and fan means for directing an air flow past said thermal heat sink plate.

13. A compact cooling unit for a plurality of equal size, liquid filled containers having cylindrical body portions, comprising, in combination:

a cabinet having front, back, side, top and bottom walls;

a vertical divider wall extending from the front to the back wall and dividing the interior of the cabinet into two cooling chambers;

the front wall of each said cooling chamber having a pair of vertically spaced openings sized to permit ready passage of containers therethrough with the cylindrical axis of the containers disposed horizontally;

means in each said chamber defining a channel supporting containers for rolling movement between the upper portion of said front wall opening and the lower portion of said front wall opening;

each said channel having an upper portion communicating with said upper opening, a lower portion communicating with said lower opening and an intermediate portion connecting said upper and lower channel portions and having a rear wall inclined at an angle relative to said bottom and back walls of said cabinet;

each said inclined rear wall having a metallic surface;

a thermoelectric cooling unit mounted in each said inclined rear wall; each said unit having heat transmitting means respectively contacting said metallic surface of said inclined rear wall of said channel, thereby cooling said containers by conduction and the interior of said cabinet by convection;

an insulated door mounted in each said opening for rotation; and each said door being constructed and arranged to pass a container through the respective opening by rotation of the respective door without opening the interior of the cabinet to an outflow of cooled air contained therein.

14. The apparatus of claim 13 wherein the inside wall of each said channel is defined by a core block of insulating plastic snugly mounted between the side walls of said cabinet and traversing an opening in said divider wall.

15. A compact cooling unit for a plurality of equal size, liquid filled containers having cylindrical body portions, comprising, in combination:

a cabinet having front, back, side, top and bottom walls;

a vertical divider wall extending from the front to the back wall and dividing the interior of the cabinet into two cooling chambers;

the front wall of each said cooling chamber having a pair of vertically spaced openings sized to permit ready passage of containers therethrough with the cylindrical axis of the containers disposed horizontally;

means in each said chamber defining a channel supporting containers for rolling movement between the upper portion of said front wall opening and the lower portion of said front wall opening;

each said channel having an upper portion communicating with said upper portion, a lower portion communicating with said lower opening and intermediate portion connecting with said upper and lower channel portions and having a rear wall inclined at an angle relative to said bottom and back walls of said cabinet;

each said inclined rear wall having a metallic surface;

a pair of thermoelectric cooling units respectively mounted in said inclined rear walls, said units having heat transmitting means respectively contacting said inclined metal rear walls of said channels, thereby cooling said containers by conduction and the interior of said cabinet by convection;

each said thermoelectric cooling unit having a heating surface;

a heat sink plate abutting said heating surface;

an insulated door mounted in each said opening for rotation; and each said door being constructed and arranged to pass a container through the respective opening by rotation of the respective door without opening the interior of the cabinet to an outflow of cooled air contained therein.

16. A compact cooling unit for a plurality of equal size, liquid filled containers having cylindrical body portions, comprising, in combination:

a cabinet having insulated front, back, side, top and bottom walls;

each of said walls having an inner face;

said front wall having two vertically spaced openings sized to permit ready passage of the containers therethrough with the cylindrical axis of the containers disposed horizontally;

means in said cabinet cooperating with said inner faces of said top, rear and bottom walls to define a channel supporting the containers for rolling movement between said upper opening and said lower opening, thereby permitting stacking of a plurality of said containers in said channel;

said channel having an upper portion communicating with said upper opening, a lower portion communicating with said lower opening, and an intermediate portion connecting said upper and lower portions, said intermediate portion being generally parallel to said rear wall of said cabinet;

said cabinet rear wall having a vertically inclined lower portion having an opening therethrough;

a thermoelectric cooling unit having a cooling surface and a heating surface spaced from said cooling surface;

means for mounting said thermoelectric cooling unit in the outer end of said opening;

a heat transmitting block of metal disposed in said opening;

a strip of metallic material forming said inner face of said rear wall and overlying said rear wall opening; and means for securing said metallic strip in intimate engagement with said heat transmitting block, thereby cooling containers passing through said channel by conduction.

17. A compact cooling unit for a plurality of equal size, liquid filled containers having cylindrical body portions, comprising, in combination:

a cabinet having insulated front, back side, top and bottom walls;

each of said walls having an inner face;

said front wall having two vertically spaced openings sized to permit ready passage of the containers therethrough with the cylindrical axis of the containers disposed horizontally;

a hollow plastic core element filled with plastic foam mountable in said cabinet between said side walls;

said core element cooperating with said inner faces of said top, rear and bottom walls to define a channel to support the containers for rolling movement between said upper and lower openings in said front wall;

said channel including a metallic strip secured in abutting relation to a container contacting portion of said channel; and thermoelectric cooling means for cooling said metallic strip.

18. The apparatus of claim 17 further comprising a pair of rotatable insulated doors respectively mounted in said upper and lower openings in said front wall;

each of said doors comprising a hollow body having an outer cylindrical segment wall and a connecting wall concavely recessed to surround one of the cylindrical containers to move same through the respective door opening by rotation of the respective door.

19. The apparatus of claim 17 wherein said plastic core element defines an internal recess; and a mass of desiccant contained in said recess to absorb water from the interior of said cabinet.

* * * * *